United States Patent [19]

Jordan

[11] Patent Number: 4,792,282

[45] Date of Patent: Dec. 20, 1988

[54] LIQUID PUMP

[75] Inventor: Robert L. Jordan, Klamath, Calif.

[73] Assignee: A. Janet Jordan, Klamath, Calif. ; a part interest

[21] Appl. No.: 57,391

[22] Filed: Jun. 3, 1987

[51] Int. Cl.[4] ..... F04F 5/00

[52] U.S. Cl. ..... 416/176; 415/71; 440/47

[58] Field of Search ..... 415/71–74, 415/52, 53 R, 112; 416/176 R, 238; 440/41, 47, 52

[56] References Cited

U.S. PATENT DOCUMENTS

| | | | |
|---|---|---|---|
| 53,902 | 4/1866 | Tripp | 416/238 |
| 1,514,293 | 11/1924 | Lawaczeck | 416/176 R |
| 1,806,345 | 5/1931 | Halvorsen | 416/238 |
| 3,442,220 | 5/1969 | Mottran et al. | 415/215 |
| 3,771,900 | 11/1973 | Baehr | 416/176 |
| 4,004,541 | 1/1977 | Onal | 440/41 |
| 4,080,099 | 3/1978 | Snyder | 416/238 |
| 4,176,616 | 12/1979 | Robins | 440/47 |
| 4,334,826 | 6/1982 | Connolly et al. | 416/242 |
| 4,459,117 | 7/1984 | Jordan | 440/38 |
| 4,648,796 | 3/1987 | Maghenzani | 415/71 |

FOREIGN PATENT DOCUMENTS

| | | | |
|---|---|---|---|
| 182014 | 3/1907 | Fed. Rep. of Germany | 416/DIG. 2 |
| 2135943 | 2/1973 | Fed. Rep. of Germany | 416/183 |

*Primary Examiner*—Robert E. Garrett
*Assistant Examiner*—John T. Kwon
*Attorney, Agent, or Firm*—Townsend and Townsend

[57] ABSTRACT

A liquid pump having a rotary impeller of improved construction to eliminate the cavitation in the pump housing. Motor noises are muffled because the exhaust port of the pump is on the heel of the skimmer plate of the pump which is slightly below the water line, allowing the water to act as a muffler. Also, in use of the pump in outboard motors, further efficiency is caused by the Venturi effect created when water passes over the exhaust port. A reverse mechanism is mounted internal to the discharge end of the pump housing to prevent the accumulation of debris on the reverse mechanism. The impeller includes helical blades mounted on an inverted cone. Each blade has an inner peripheral portion near the axial center line of the impeller to present a negative radial rake which decreases as the upper end of the blade is approachable. Each blade has an outer peripheral portion provided with a positive radial rake which increases as the upper end of the blade is approached. The impeller has a positive axial rake for its entire axial length. Finally in the use of the pump on outboard motors, the liquid is directed to the power head of the motor for cooling purposes, thereby eliminating the need for additional cooling apparatus. While the pump invention is described herein for in use on outboard motors, it can also be used effectively and efficiently when other such uses including but not excluding: hydraulic mining, fire hose use, moving water into a live fish tank, filling tankers in remote areas, and other useful purposes, such as agricultural irrigation.

12 Claims, 5 Drawing Sheets

LIQUID PUMP

This invention relates to the movements of fluids through a restricted passage and, more particularly, to a liquid pump, such as a water pump, usable in an outboard motor or in other applications in which liquids are discharged from a confined fluid passage at a high velocity. While recognizing that the present invention has a number of different applications, it is for the purpose of the present application that the pump of the present invention is described in the use of replacing an outboard motor propeller with a jet drive which is the use of the pump. Other examples of the pump of the present invention are suitable for industrial and agricultural uses or for uses where a large volume of fluid needs to be moved at the highest fluid velocity possible.

BACKGROUND OF THE INVENTION

Water pumps which are now in service generally have a mixed flow impeller that allows too much air into the fluid intake of the pump. These pumps discharge the air along with the water through their outlets or exit nozzles. At all times, the air is in the form of air bubbles and these air bubbles burst inside the housing of a pump, causing extremely high pitched whining noises. These noises are called implosions or cavitations which erode the working surfaces of the impeller of a pump and/or the internal passages of the pump housing. It is, therefore, desirable to minimize the amount of air which is allowed to pass through a water pump to eliminate the implosions or cavitations and thereby extend the life of the impeller and the housing surfaces of the pump. The present invention provides a liquid pump which avoids this problem.

SUMMARY OF THE INVENTION

The present invention is directed to a liquid pump having a rotary impeller of improved construction to eliminate the cavitation or whining noises mentioned above. The impeller of the present invention also permits the liquid pump to operate at decreased horsepower for a given fluid exit velocity or dynamic force produced by the pump. The noises are also muffled because the exhaust from the motor of the liquid pump is on the heel of the suction port or skimmer plate of the pump housing which is slightly below the water line, allowing the water to act as a muffler.

The liquid pump of the present invention has a reverse mechanism mounted internal to the discharge end of the housing. This feature prevents the accumulation of debris on the reverse mechanism that is always floating near the surface of the liquid in which the pump is used.

The improved impeller of the present invention includes a plurality of helical blades mounted on an inverted cone that is hollow in the upper portion to accommodate a spring-loaded, rotary seal around the central drive line of the motor used to rotate the impeller. This feature allows for the seal to endure the severe treatment which it is normally subjected to because of the unusual liquid condition it must be able travel through, such as mud, salt and the like.

The leading edge of each blade of the impeller has an inner end near the axial center line of the impeller but forwardly of a radial line from the center line, causing the inner zone of the impeller blade edge to have a negative radial rake. As the leading edge of the blade extends toward the outer periphery of the impeller, it curves to a more negative effect at about one third of the radial distance. At this point, the curve begins to move in the opposite direction until finally the radial rake becomes and remains positive until the leading edge reaches the outer periphery of the impeller. As each blade extends helically upwardly, the negative radial rake of the blade decreases and the positive radial rake increases.

The impeller employs a positive axial rake angle for its entire axial length. The inverted cone on which the blades of the impeller are helically mounted extends throughout substantially the entire axial length of the impeller.

The impeller is in a housing that has a stator vane to direct the liquid along a curved path from the impeller toward and into the discharge nozzle of the pump. It is at the end of the discharge nozzle that the liquid pump exerts its driving force.

The stator vane has a small volute or passage that allows the impeller at its outside diameter to force liquid into the power source of the pump for cooling purposes. The volute is situated to the side of the path of liquid from the impeller to the nozzle so as to form a channel by which water is fed to the power source as needed for cooling.

The liquid intake scoop connects to the lower center of the pump housing. Exhaust gases are forced through the pump and through a passage in the rear section of the intake scoop. Behind the intake scoop, the exhaust port is angled upwardly. This feature causes an aspirating effect on the lower end of the exhaust port which decreases the back pressure of the exhaust system, allowing more power to be delivered by the power source. The result is a more efficient power source with less fuel consumption and less pollution to the environment.

A primary object of the present invention is to provide a liquid pump having an impeller of improved design wherein the impeller causes a minimal amount of air to be driven through the pump to thereby avoid cavitation or implosions caused by too much air in the fluid flow through the pump to thereby extend the life of the impeller and the housing of the fluid pump.

Other objects of this invention will become apparent as the following specification progresses, reference being had to the accompanying drawings for an illustration of a preferred embodiment of the invention.

IN THE DRAWINGS

Figure 1:
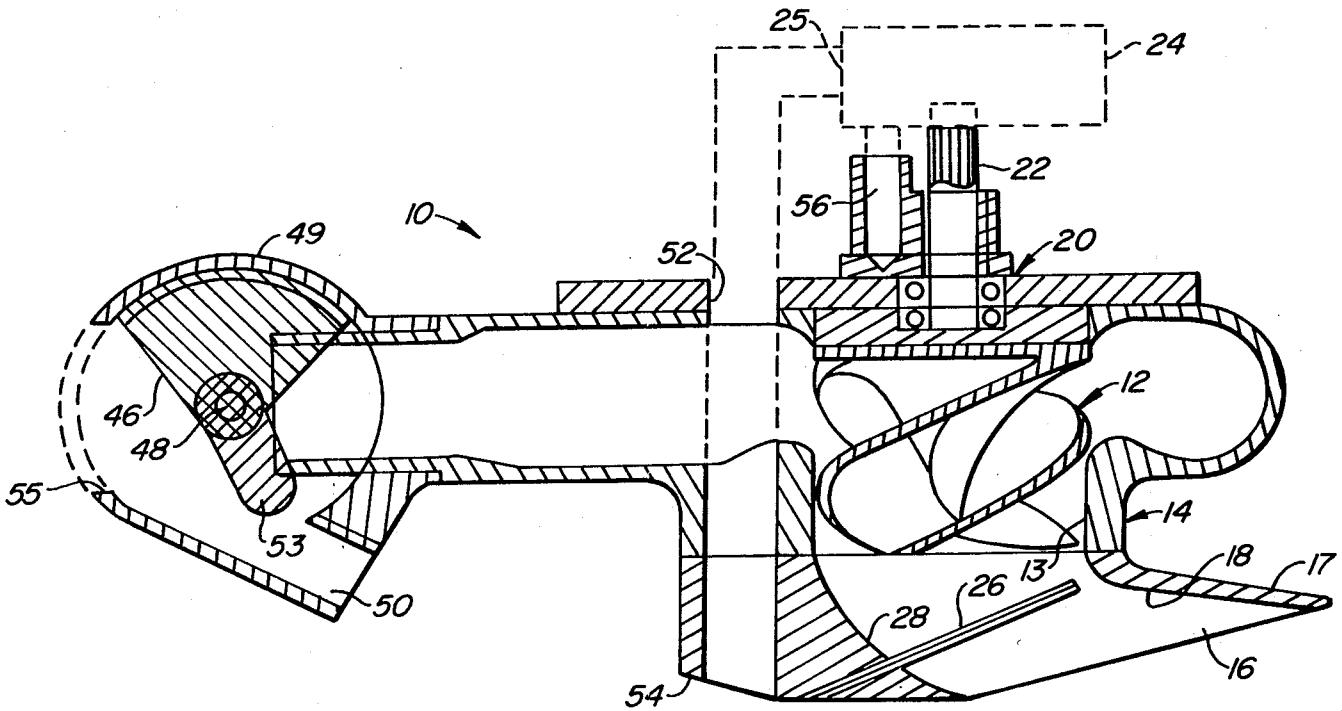
FIG. 1 is a vertical sectional view through the liquid pump of the present invention, showing the improved impeller in place for drawing liquid, such as water, upwardly through a suction port and through and outwardly of the housing of the pump.

The liquid pump of the present invention is broadly denoted by the numeral 10 and is shown in vertical section in FIG. 1. Liquid pump 10 includes an improved impeller 12 in a vertical fluid passage 13 of a housing 14 provided with skimmer plate 17 having a suction port 16 at the upstream end of a curved fluid passage 18 leading to the inlet or lower end of passage 13. The housing 14 is provided with bearing means 20 coupled with a drive shaft 22 for mounting the impeller for rotation about a generally vertical axis in a predetermined direction when the drive shaft is coupled to a power source 24, such as a motor having an exhaust outlet 25.

The suction port is inclined at an angle to the horizontal as shown in FIG. 1, and a plurality of spaced pins 26 project forwardly and upwardly from a lower rear wall 28 of the housing to trap debris or fish which would have a tendency to flow into and through the housing. Pins 26 also prevent the fingers and hand of a person from entering the impeller area of the pump.

The impeller is provided with an upper surface and the impeller discharges water into a curved, generally horizontal fluid passage 32 (FIG. 5) defined by a curved wall 34 which extends from a location 36 to a location 38 where it connects with a relatively straight wall 39 to form a first, relatively straight fluid passage 40 which connects with a second, relatively straight fluid passage 42 at an angle to passage 40. Passage 42 terminates at a discharge nozzle 44.

A reversing cup 46 is pivotally mounted by shaft 48 (FIG. 1) in a shell at the rear end of the housing near the discharge nozzle 44. An arm 51 is used as part of a control linkage for selectively and remotely rotating the cup. This reversing cup 46 allows for forward movement of the liquid pump 10 when the reversing cup 46 is in its first operative position shown in FIG. 1. When the cup is in a second operative position blocking the flow of liquid out of discharge nozzle 44, such as when the cup is rotated in a counter clockwise sense (viewing FIG. 1) through an angle of approximately 90° from the position shown in FIG. 1, the cup will cause the liquid leaving the discharge nozzle 44 to strike the cup and then flow forwardly through a pair of inclined discharge passages 50 only one of which is shown in FIG. 1. This causes the reversing of the movement of liquid pump 10. Additionally, when the cup is in a third operative position, only partially blocking the forward discharge force and only partially diverting the forward force into the reversing nozzle, of consequence and equalizing force has been created. This will cause the craft to hover in one position.

Figure 5:
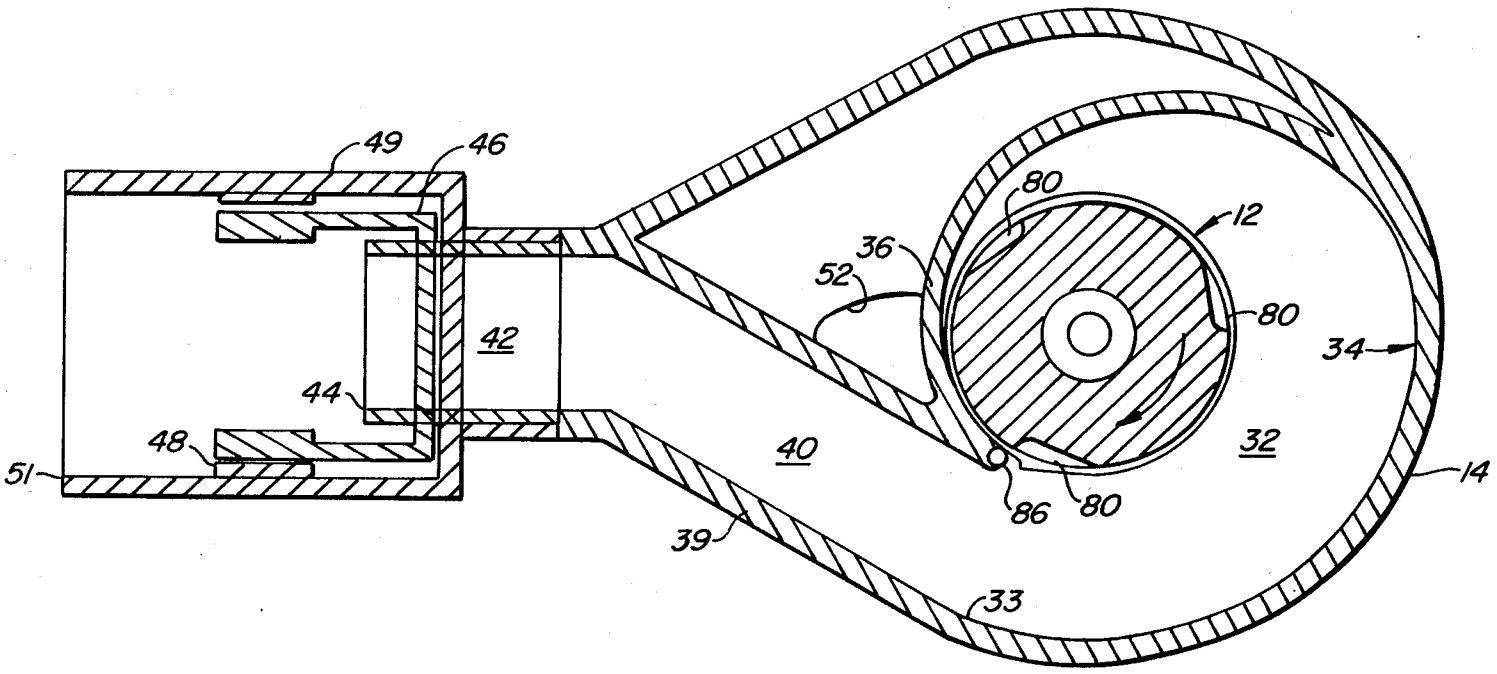
FIG. 5 is a horizontal section through the liquid pump of the present invention.

Housing 14 has an exhaust passage 52 which is at one side of passage 40 as shown in FIG. 5. The exhaust passage 52 directs exhaust gases from power source 24 downwardly through the pump and through the rear section of the body forming the intake scoop. At the rear end of wall 28, the exhaust port is located and is angled upwardly and rearwardly as shown at location 54 (FIG. 1). This causes an aspirating effect when water flows past the lower, open end of passage 52. This aspirating action decreases the back pressure on the exhaust system and thereby allows more power to be delivered by power source 24. The result is a more efficient power source with less fuel consumption and less pollution to the environment.

A cooling passage 56 (FIG. 1) is provided in housing 14 to permit cooling water to be directed upwardly to and through the power source 24 to cool it. The cooling passage is in fluid communication with fluid passage 32 and water is forced into passage 56 by the rotation of impeller 12 for flow to the power source to cool it.

Figure 2:
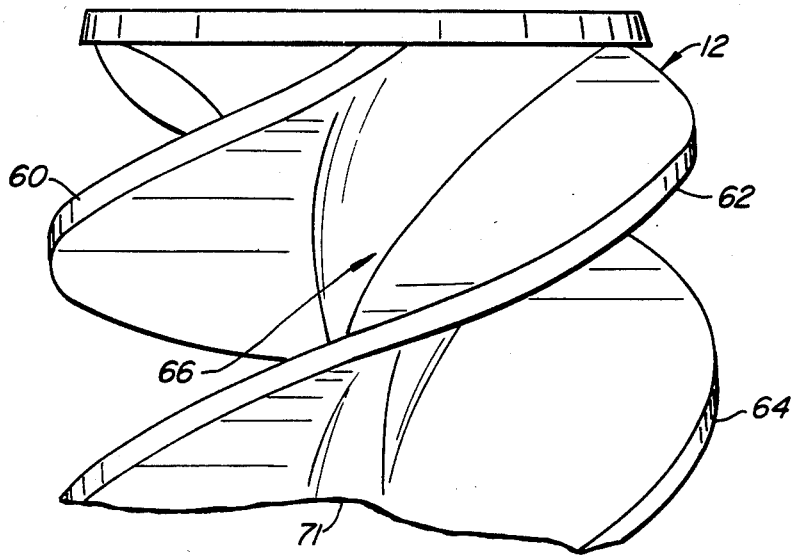
FIG. 2 is an enlarged, side elevational view of the impeller of the present invention.

The impeller can have one or more impeller blades and the blades are shown herein as 3 and denoted by the numerals 60, 62 and 64 (FIG. 2). The blades are mounted on an inverted cone denoted by the numeral 66 (FIG. 2) that is hollow at its upper end to accommodate a spring-loaded rotary seal around the central drive line of the impeller. This feature allows for the impeller to endure severe treatment due to the unusual liquid conditions it travels through, such as mud, salt and the like.

Figure 3:
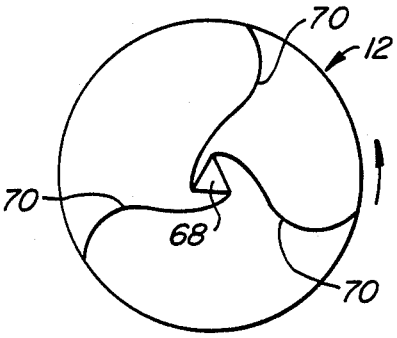
FIG. 3 is a bottom plan view of the impeller.

The leading edge of each blade is shown in bottom plane form in FIG. 3 with reference to the central axis 68 of the impeller. Each leading edge, denoted by the numeral 70 in (FIG. 3), starts near center line 68 but forwardly of the radial axis 71 (FIG. 4), causing that zone of the impeller blade to have a negative radial rake. Negative and positive radial rakes are illustrated as angles in FIG. 4 with reference to the direction of rotation of the impeller 12 and with respect to the central axis 68 of the impeller.

As the leading edge 70 (FIG. 3) of each of the blades extends outwardly from axis 68, the leading edge curves to a more negative effect until it has reached about one sixth of the blade radial length. At this point, the curve of the leading edge begins to move in the opposite direction until finally the radial rake is positive in the vicinity of the pump 73. FIG. 3 shows the leading edge 70 of the impeller blades and shows the negative and positive radial rakes of each leading edge.

The negative radial rake of each blade decreases progressively as the blade extends upwardly. Also, the positive radial rake remains constant as the blade extends upwardly. The impeller 12 (FIG. 2) has a positive axial rake along its entire length.

The advantage of providing the negative and positive radial rakes for each blade as described is to allow for the taking in of water to the maximum capacity of the pump. The water is almost like compressed water but the blades compress the air from the water. Thus, air bubbles are squeezed out of the water and the impeller scoops up liquid more efficiently than if each blade's leading edge were straight since the blade length is increased to provide more contact with the water. This will increase the pump's dynamic force and avoid cavitation or implosions which are destructive of the surfaces interiorly of the housing. By reducing the implosions, the horsepower needed to achieve the required velocity or required dynamic forces is reduced.

Figure 4:
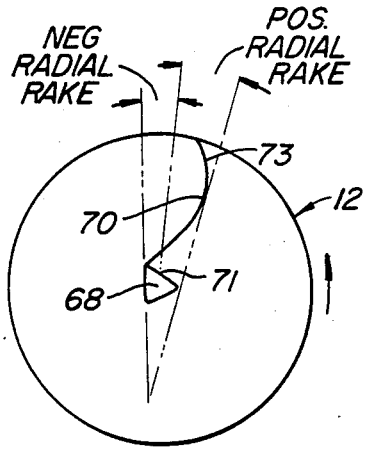
FIG. 4 is a view similar to FIG. 3 but showing the way in which the leading edge of each vane of the impeller is provided with a positive and negative radial rakes.

The leading edge of each blade passes over the center line to its confluence with an adjacent impeller blade as shown in FIG. 4. This feature, along with the negative and positive radial rakes of the leading edge 70 of each blade, causes the leading edges of the impeller blades to be longer than one half of the dameter of the impeller. At the confluence of a first blade's leading edge and a second blade's leading edge, negative radial rake is created. The negative radial rake increases for a small portion of the length of each leading edge which then is curved to provide a positive radial rake near the outer periphery of the blade. This feature causes the leading edge of each blade near the outer periphery of the blade to have a "scooping" effect. Each blade for its entire length has an axial rake angle which is positive. This further increases the scoop action of the impeller blades which requires less horse power so as to provide more force, delivered by the fluid pump.

Cooling volute or passage 56 (FIG. 1) is provided to receive liquid from fluid passage 32 (FIG. 5). To this end, the upper part of impeller 12 has spaced pockets 80 (FIG. 5) communicating with passage 32 as the impeller rotates. The water in each pocket 80 (FIG. 5) is slung upwardly and through the passage 86 shown in dashed lines in FIG. 5 and the water is directed into passage 56 (FIG. 1) for flow to power source 24.

The cooling water then is discharged from power source 24 into the exhaust passage 52 for exit through port 54 (FIG. 1). The volute entrance end 86 (FIG. 5) has a scooping action which slices water off the impeller and carries the water in the passage 80 (FIG. 5) of the power head. This eliminates the need for a water pump.

The reversing cup 46 (FIG. 1) is rotatably housed in shell 49 (FIG. 1). When the reversing cup is actuated, water is diverted into the two discharge ports 50 (FIG. 1) which point forwardly approximately 120° from the rear exit opening 55 of shell 49 (FIG. 1). These two ports 50 (FIG. 1) are arranged angularly so that they will not interfere with the engine exhaust system. These angles are determined so that the discharge flow passes around the exhaust system so as to complement the suction that is created on the exhaust system. Any interference on the exhaust system would minimize the efficiency of the power source 24 (FIG. 1) which is complemented by the suction force of the Venturi. Further, the dynamic force of the reversing system has been reduced so as not to create excessive motion of the liquid pump 10 (FIG. 1) which could swamp a boat attached to the pump when going in reverse.

Figure 7:
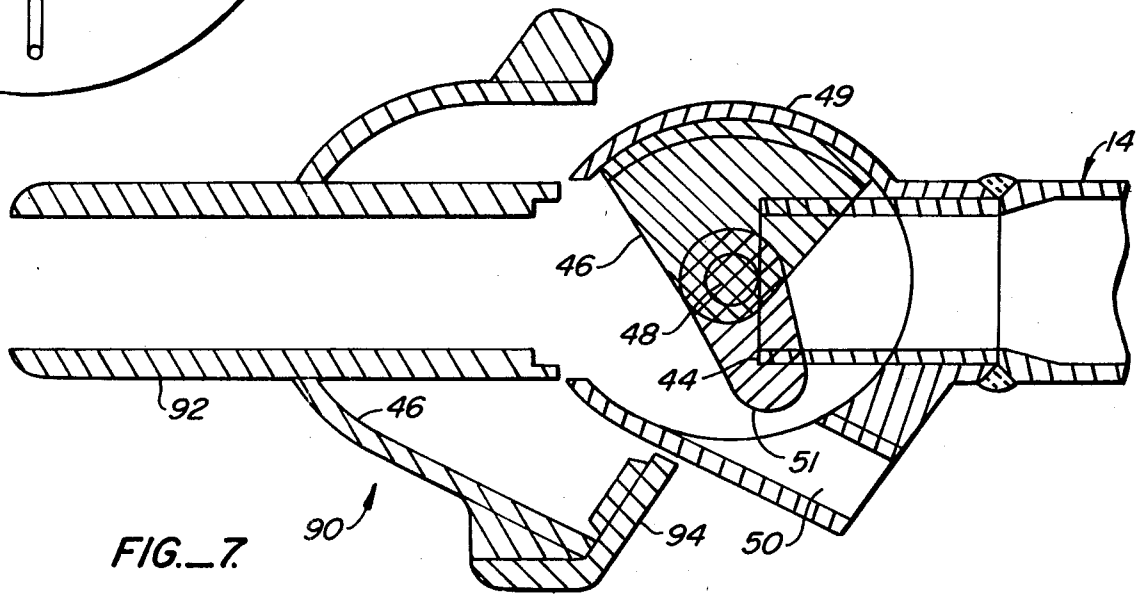
FIG. 7 is a cross-sectional view of a fire hose attachment for the discharge outlet of the liquid pump of the present invention.
Figure 6:
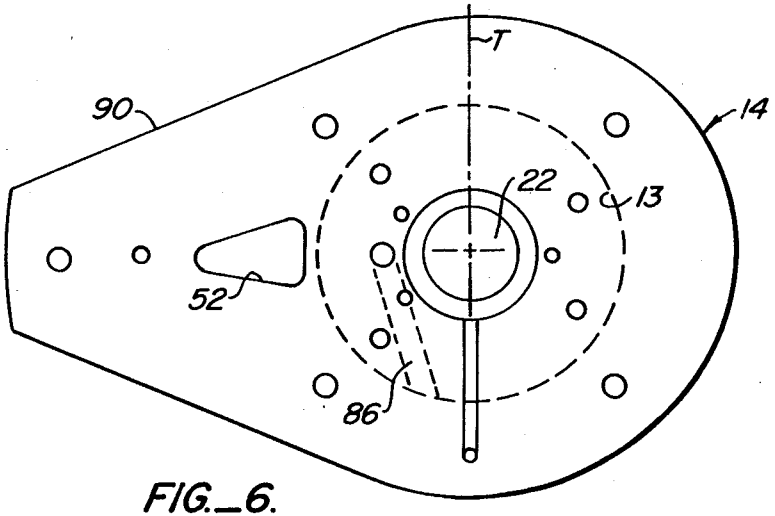
FIG. 6 is a top plan view of an adapter plate forming a part of the liquid pump of the present invention.
Figure 8:
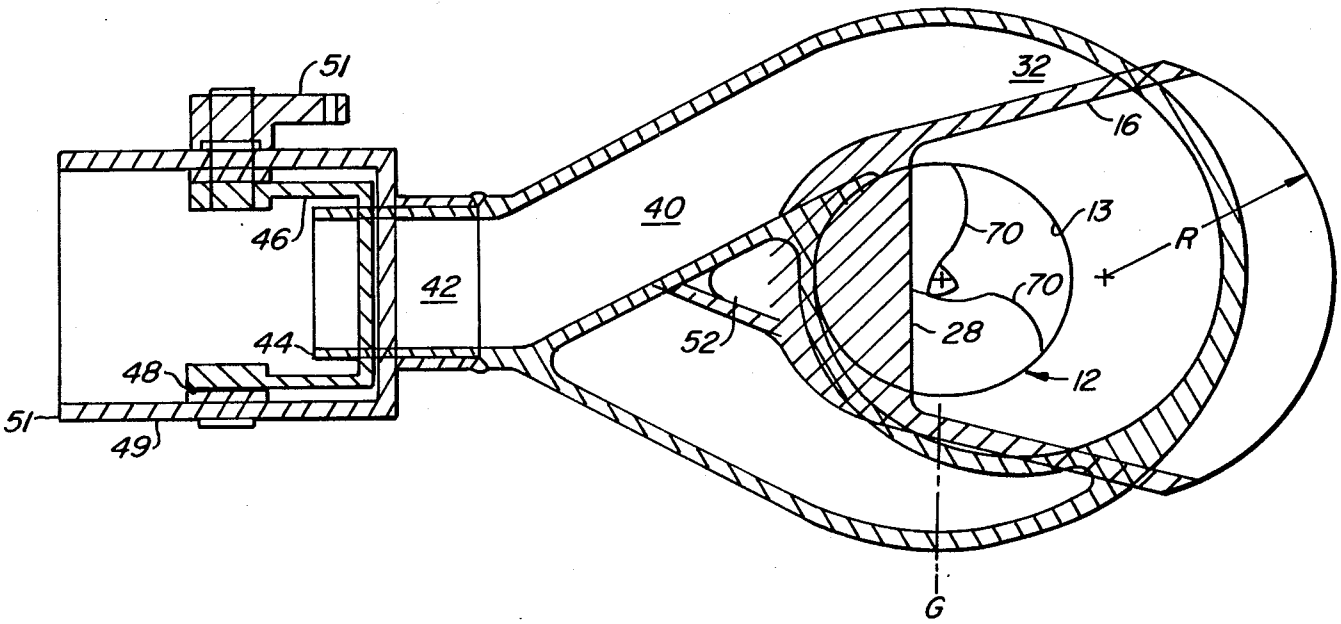
FIG. 8 is a horizontal section through the liquid pump and looking upwardly from the bottom of the pump.

An adapter 90 (FIG. 7) can be used to attach to shell 49. The adapter provides a fire hose discharge tube 92 (FIG. 7) for directing a powerful stream of water rearward when impeller 12, is rotating. This stream of water can be used for adapting to such purposes as hydraulic mining, fire hose use, washing decks on a fishing boat, de-scaling of fish, moving water into a live fish tank, filling tankers in remote areas, and other useful purposes. The adapter 90 (FIG. 7) attaches to a bracket 94 secured in some suitable manner to shell 49. Discharge tube 92 (FIG. 7) is coupled by a shell 96 to bracket 94 rearward of shell 49.

Skimmer plate 17 (FIG. 1) is most nearly designed for the capacity of the discharge nozzle 44 (FIG. 5). The intake area of the skimmer plate 17 (FIG. 1) has been selected on a basis of the following:

An attempt to draw excessive liquid into the discharge nozzle 44 (FIG. 5) is impossible because the capacity of the nozzle will allow a limited flow based upon the velocity of discharge and the discharge pressure. Thus, the attempt to take on additional liquid into the discharge nozzle will cause the pump to push a head of liquid in front of it which will create a severe drag. Engineering texts teach that a reduction of the size of a discharge nozzle will increase the pressure of the liquid at the discharge port and further teach that it will change the velocity of the liquid at the discharge nozzle. It is not possible to increase velocity of a liquid by any means other then following the principle that velocity is based entirely upon the diameter of the impeller and the speed of rotation of the impeller.

I claim:

1. A liquid pump comprising:

a housing having a suction port, a discharge nozzle and a fluid passage extending between the suction port and the discharge nozzle; a rotatable impeller in the housing across the fluid passage, said impeller having a conical hub and one or more helical blades on the hub for causing a flow of liquid through said fluid passage as the impeller rotates in one direction relative to the housing, each blade having a leading edge; and means coupled with the impeller for rotating the same in said direction, the leading edge of each blade having a negative radial rake and a positive radial rake, each blade having a negative radial rake and a positive radial rake at locations on the blade spaced from its leading edge, each blade having a positive axial rake wherein each blade has the negative radial rake near the central axis of the impeller and the positive radial rake near the outer periphery of the impeller.

2. A liquid pump as set forth in claim 1, wherein the leading edge of each blade has a radially innermost portion and a radially outermost portion, one of the portions having the negative radial rake and the other portion having the positive radial rake.

3. A liquid pump as set forth in claim 2, wherein the portions are curved and each blade has a third portion smoothly interconnecting its curved portions.

4. A liquid pump as set forth in claim 2, wherein the innermost portion has the negative radial rake.

5. A liquid pump as set forth in claim 1, wherein each blade has a radially innermost portion and a radially outermost portion, the innermost portion having a negative radial rake and the outermost portion having a positive radial rake.

6. A liquid pump as set forth in claim 5, wherein the negative radial rake of each blade decreases as the upper end of the blade is approached.

7. A liquid pump as set forth in claim 5, wherein the positive radial rake of each blade increases as the upper end of the blade is approached.

8. A liquid pump as set forth in claim 1, wherein is included an exhaust passage having a lower open end and extending through the housing adjacent to the fluid passage, said exhaust passage adapted to be coupled to the exhaust means of the rotating means for directing exhaust gases into the region below the housing.

9. A liquid pump as set forth in claim 1, wherein is included a shell mounted on the housing near the discharge nozzle thereof, and a reversing cup rotatably mounted within the shell, there being a reverse discharge fluid passage extending forwardly for receiving fluid striking the reversing cup when the latter is in an operative position across the path of flow of fluid from the discharge nozzle.

10. In a liquid pump having a fluid passage extending between a suction port and a discharge nozzle: an impeller adapted to be rotatably mounted in the housing across the fluid passage, said impeller having a conical hub and number of helical blades on the hub for causing a flow of liquid from the suction port to the discharge nozzle as the impeller rotates relative to the housing, each blade having a leading edge provided with a negative radial rake near the hub and a positive radial rake remote from the hub, each blade having a negative radial rake and a positive radial rake at locations on the blade spaced from its leading edge, each blade having a positive axial rake wherein each blade has the negative radial rake near the central axis of the impeller and the positive radial rake near the outer periphery of the impeller.

11. A liquid pump as set forth in claim 10, wherein the negative radial rake of each blade decreases as the upper end of the blade is approached.

12. A liquid pump as set forth in claim 10, wherein the positive radial rake of each blade increases as the upper end of the blade is approached.

* * * * *